United States Patent [19]

Yaniger

[11] 4,267,764

[45] May 19, 1981

[54] ARRANGEMENT FOR USE IN PROJECTILE LAUNCH SIMULATION

[75] Inventor: Christopher J. Yaniger, Lutherville, Md.

[73] Assignee: AAI Corporation, Cockeysville, Md.

[21] Appl. No.: 44,624

[22] Filed: Jun. 1, 1979

[51] Int. Cl.[3] ..... F41F 11/00

[52] U.S. Cl. ..... 89/25; 42/1 R; 42/8; 89/27 A

[58] Field of Search ..... 42/1 R, 1 F, 1 G, 1 H, 42/1 TB, 1 Z, 8, 41, 70 R; 89/1.704, 25, 27 R, 27 A

[56] References Cited

FOREIGN PATENT DOCUMENTS

Ad.591 of 1853 United Kingdom ..... 89/25

*Primary Examiner*—Stephen C. Bentley

*Attorney, Agent, or Firm*—Reginald F. Pippin, Jr.

[57] ABSTRACT

A cartridge chamber housing and a breech block for a cartridge with side-mounted primer, in which the chamber housing has a firing pin and a spring-biased slidable firing pin interrupter which is in firing-prevent position and prevents firing pin actuation except when the breech block is closed and locked, and which is moved to firing-enable position by the closure and locking of the breech block, whereby the firing pin may be actuated after such closure and locking of the breech block. The cartridge is fully chambered and extracted by and as a function of closure and opening of the breech block.

10 Claims, 8 Drawing Figures

FIG. 5
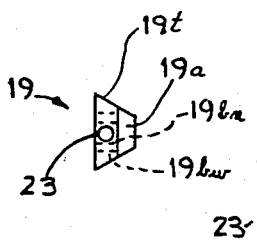
FIG. 4
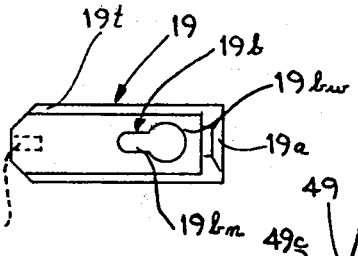
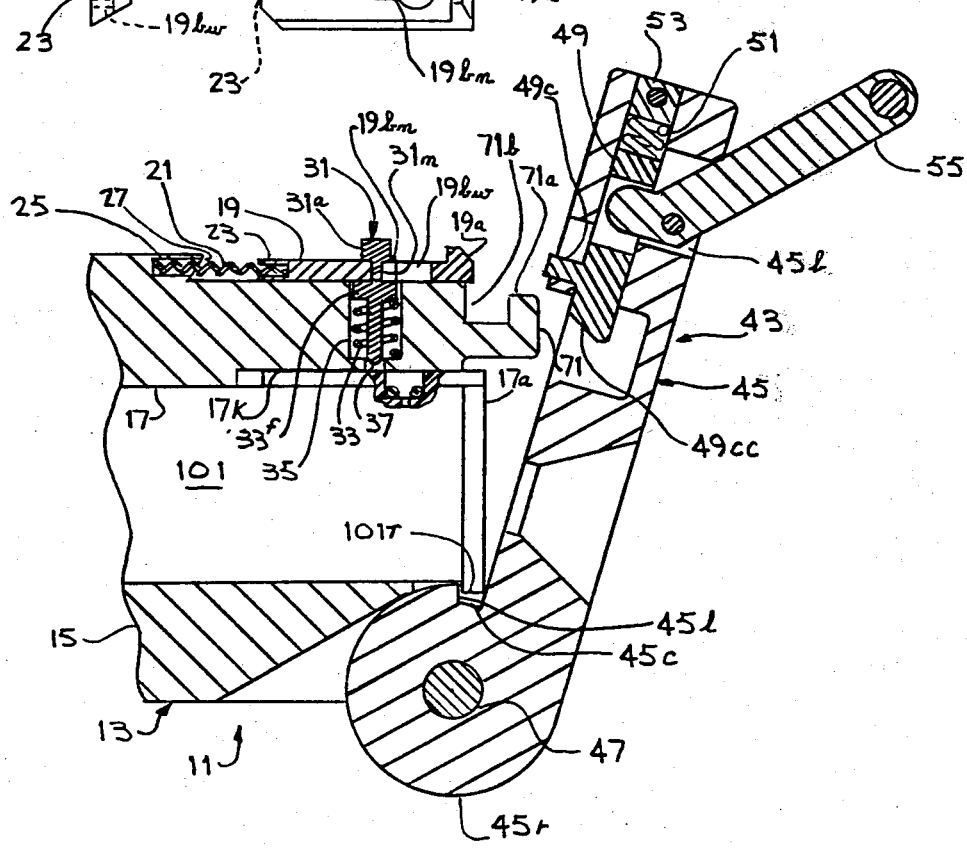
FIG. 6

ARRANGEMENT FOR USE IN PROJECTILE LAUNCH SIMULATION

This invention relates to cartridge chamber housing and breech assemblies, and more particularly to a cartridge chamber housing and breech assembly for cartridges with side-mounted primers, and having a safety interlock to prevent inadvertent or other undesired actuation of the firing pin when the breech is not fully closed and locked.

It is desirable to prevent preactuation of a firing pin before full chambering of a cartridge and locked closure of the cartridge chamber. This can be a particular problem with a cartridge having a side-mounted primer, where the firing pin does not extend through the end breech block, as the firing pin and primer may potentially be aligned and fired before closure of the breech. It is accordingly an object and feature of this invention to provide a cartridge chamber housing and breech assembly which has a safety interlock to prevent firing except when the breech is fully closed and secured.

Still other objects, features and attendant advantages will become apparent to those skilled in the art, from a reading of the following detailed description of an illustrative and preferred embodiment, taken in conjunction with the accompanying drawings wherein:

FIG. 4 is a plan view and FIG. 5 is an end view of the safety interrupter of FIG. 1.

FIGS. 6, 7 and 8 are generally diagrammatic fragmentary section views of the arrangement, respectively showing the breech block assembly in respectively partially open, closed, and closed and locked positions.

Figure 1:
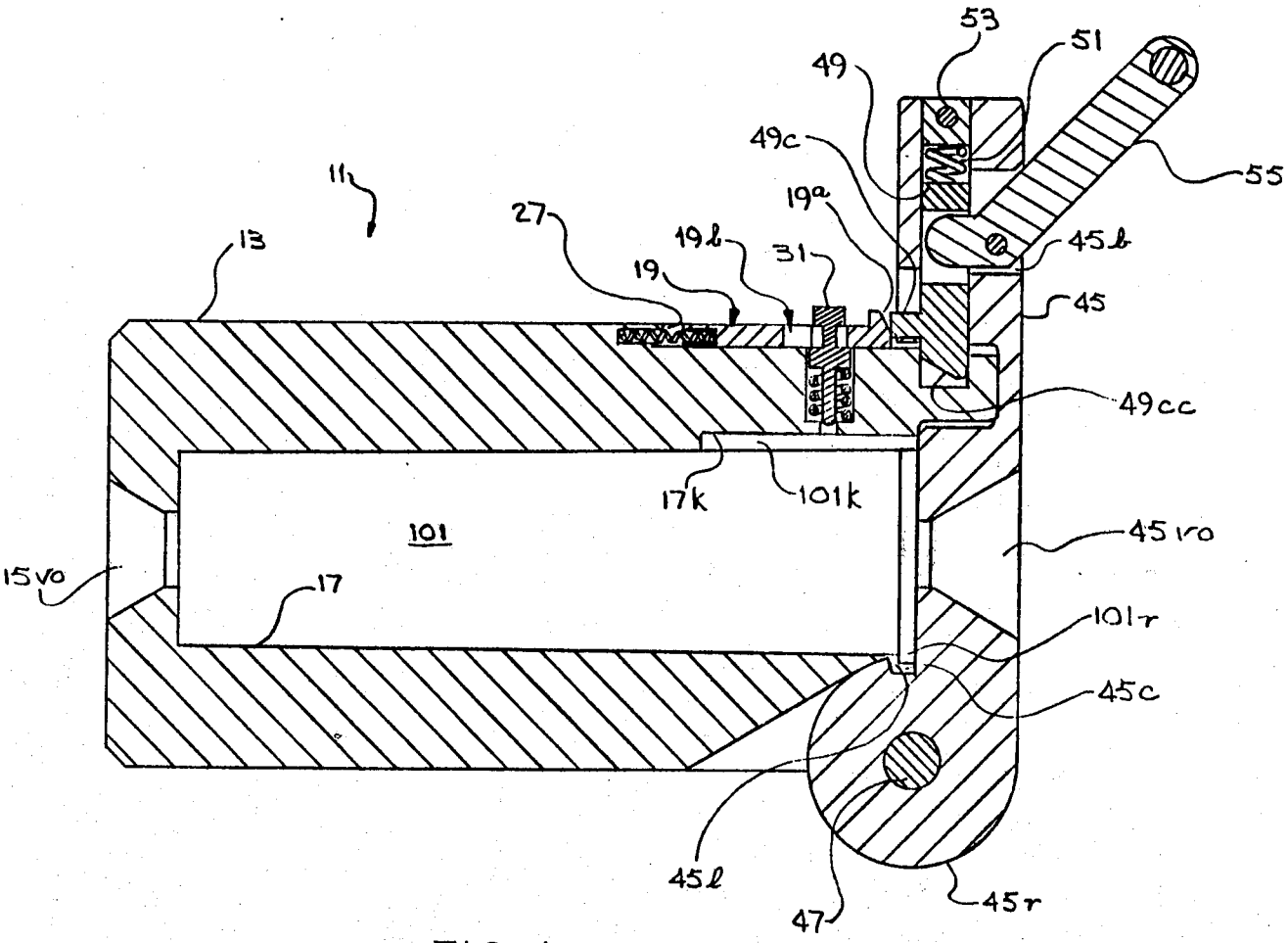
FIG. 1 is a longitudinal section view of a cartridge chamber housing and breech arrangement according to the invention, shown in the breech-closed and -locked condition.
Figure 2:
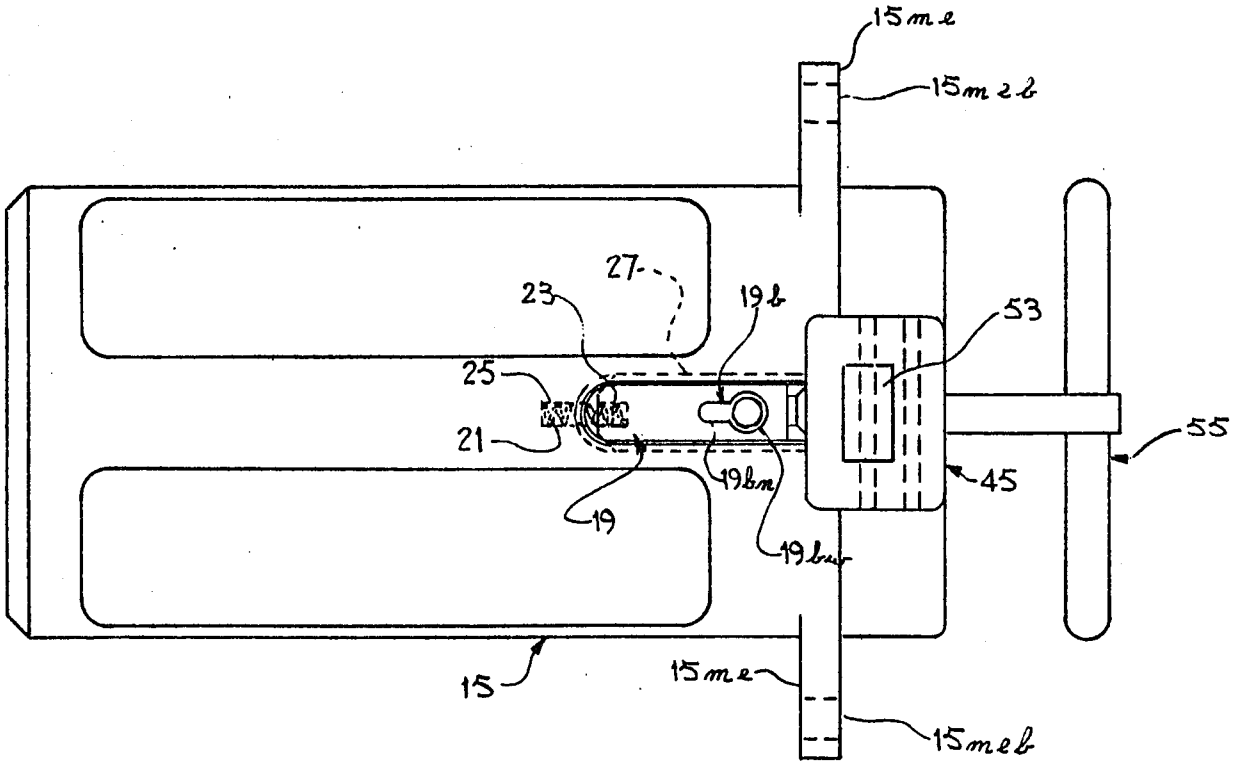
FIG. 2 is a plan view of the arrangement of FIG. 1.
Figure 3:
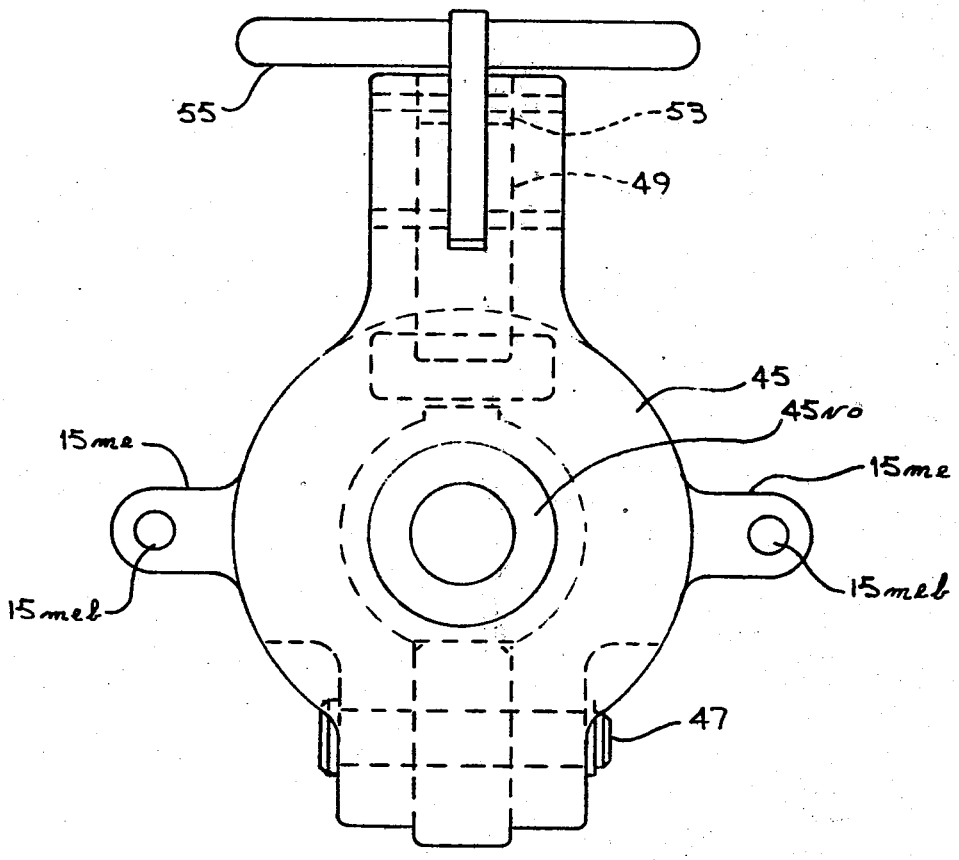
FIG. 3 is a rear end view of the arrangement of FIG. 1.

Referring now in detail to the Figures of the drawings, a chamber/breech arrangement 11 is formed by a cartridge chamber assembly 13 and a breech assembly 43. The cartridge chamber assembly 13 includes a chamber housing 15 in which is mounted a firing pin 31 and a firing pin interrupter 19, which is spring-biased rearwardly toward the firing-pin-interrupt position by a compression spring 21 contained within opposing bores 23, 25. The breech assembly 43 includes a breech block 45 which is pivotally mounted, as by a pin 47, on the rear lower end of chamber housing 15.

The cartridge 101 has a side-mounted primer 103 communicating with a propellant charge (not shown) and, if desired, the cartridge may have oppositely facing discharge nozzles (not shown) on both ends, as for simulation of launch of a rocket propelled projectile. As the details of the cartridge do not form a part of this invention, such are not shown or described herein. A cartridge of this type is shown in my copending application entitled CARTRIDGE FOR USE IN PROJECTILE LAUNCH SIMULATION, Ser. No. 44,625, filed concurrently herewith, which is referenced and incorporated herein by reference. To assure alignment of the side primer 103 of cartridge 101 with the firing pin the chamber 17 and cartridge 101 may have a respective complementary index key slot 17*k* and key 101*k* formed thereon.

Chamber housing 15 and breech block 45 may each have suitable openings 15*vo* and 45*vo* which may desirably be fan- or venturi-shaped, to accommodate the discharge of the expanding propellant gases from the cartridge upon firing thereof.

Housing 15 has mounting ears 15*me*, by which the housing may suitably be secured through bolt openings 15*meb* as for instance on or in a weapon barrel (not shown). Interruptor 19 slides freely longitudinally within a side undercut retention slot 27, formed as by milling in the top of the cartridge chamber housing 15. The sides of the interruptor 19 are chamfer tapered 19*t* to fit within the complementarily undercut slot 27. At the rear end of the interrupter 19 a rearwardly facing chamfered cam section 19*a* protrudes upwardly for engagement by a portion of the breech assembly 43 to move the interrupter 19 forward to its fully open noninterrupt position, as will be later described in more detail.

A dual width slot 19*b* extends through the midsection of the interrupter 19, the narrower width section 19*bn* of slot 19*b* being of less width than the width of the anvil end 31*a* of a vertically or otherwise radially movable firing pin 31 and of greater width than the reduced neck 31*n* of the firing pin 31. Firing pin 31 is resiliently biased radially upwardly relative to the cartridge chamber 17 and away from the percussion firing position, by a normally compressed compression spring 33 which extends between a midsection flange 31*f* on firing pin 31 and the bottom of a firing pin bore 35 formed in the upper side wall of the chamber housing 15. A reduced diameter counterbore opening 37 connects between the side bore 35 and the cartridge chamber 17 formed within chamber housing 15.

The wider width section 19*bw* of slot 19*b* is generally circular and of larger diameter than the diameter of the anvil end section 31*a* of the firing pin 31, whereby the anvil end section 31*a* may ride freely therethrough when the enlarged slot section 19*bw* is in alignment with the firing pin, whereas the firing pin 31 will be locked against downward or firing movement when the interruptor 19 is positioned with the narrower width slot section 19*bn* in alignment or partial alignment with the firing pin, due to the lower surface of firing pin anvil section 31*a* being resisted by engagement with the upper surface of the interruptor 19 when attempt is made to actuate the firing pin in this interrupt or lockout position of the interrupter 19. It will be appreciated that due to the action of compression spring 21 the normal resiliently maintained position of interruptor 19 is in the rearmost position with the firing pin locked out against firing as shown in FIG. 6. This prevents any actuation of the firing pin 31 when the breech assembly 43 is open and, as will be later described, while the breech is being closed and the cartridge 101 is being chambered within cartridge housing chamber 17.

Figure 8:
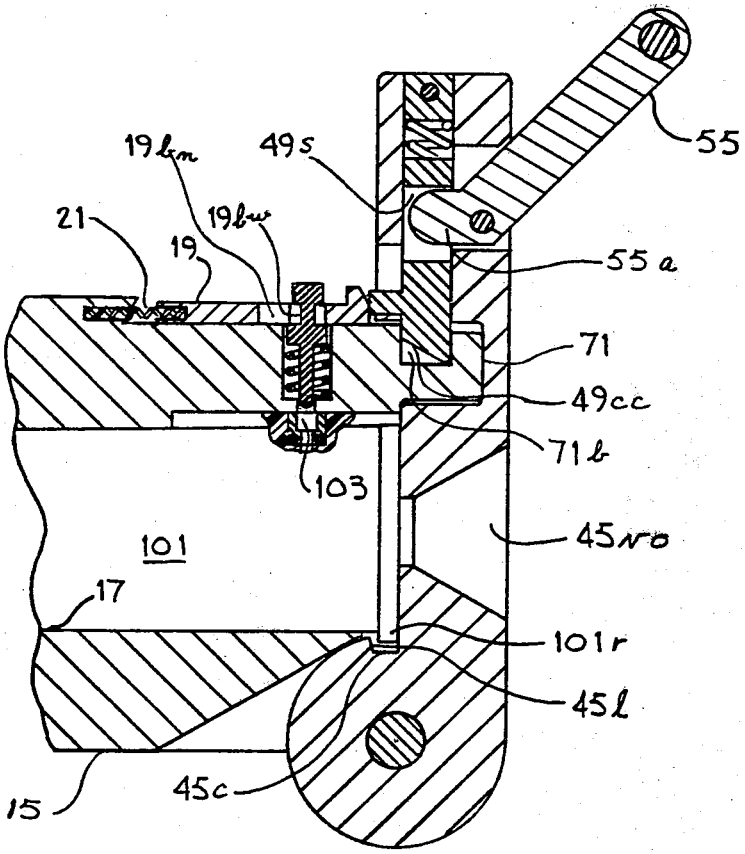

Breech assembly 43 has a resiliently biased slidable chamber/breech block lock 49 slidable within a slot 45*a* formed therein and a lock handle 55 pivotally mounted within a cutout 45*b* in the upper end of the breech block 45 as by a pin 57. A compression spring 51 extends within slot 45*a* between a pin-secured retention block 53 and the outer end of slidable chamber/breech block lock 49 to bias the lock 49 toward its innermost position, with handle 55 rotated to its forwardmost position, as shown in FIGS. 1 and 8. Breech block 45 has a radiused lower section 45*r* with a cutout 45*c* for cartridge rim accommodation, and extractor lip 451 for cartridge extraction. When the breech is opened, the spring-loaded firing pin interrupter 19 moves in the aft direction and interrupts the path of the firing pin 31, thereby preventing cartridge firing while the breech is open or partially open.

Figure 7:
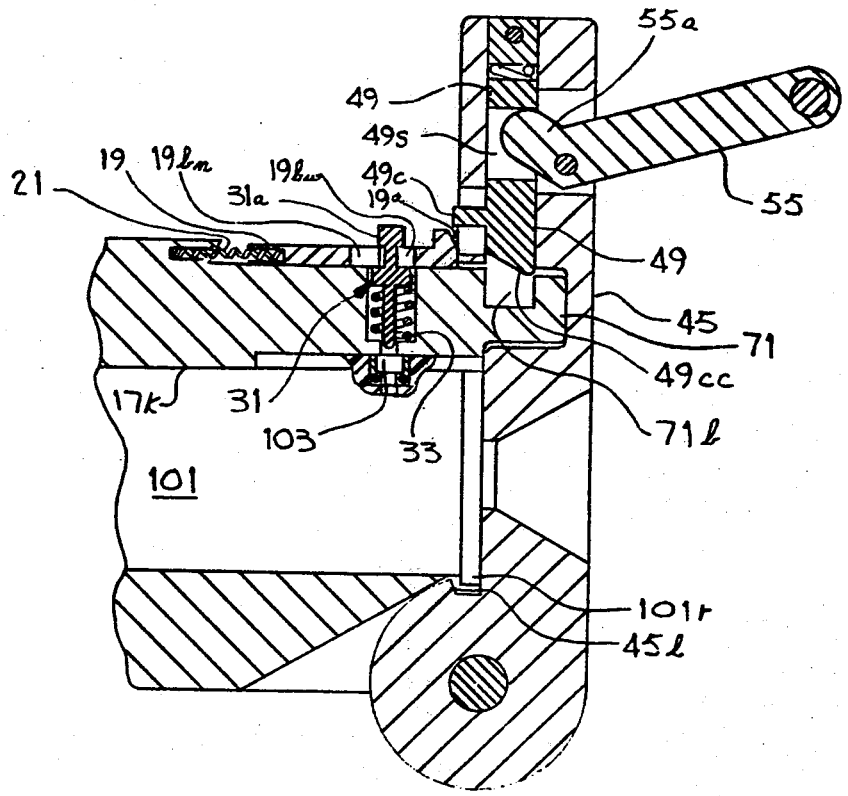

As the breech is closed, as shown in FIG. 7, the extractor cutout 49*c* of the breech block 45 accommodates the cartridge case rim 101*r* and enables the cartridge 101 to be fully chambered by the breech block 45 forward pivotal movement, and thereby to be positioned with its side-mounted primer 103 in line with the firing pin 31.

In the process of closing the breech block 45, the lock handle 55 is moved forward with the breech block 45, and the lower chamfer-cam-surfaced end 49*cc* of chamber/breech lock 49 engages and rides up over the surface 71*a* of a protruding latch 71 of or on the rear of the chamber housing 15, against the downward spring biasing action of compression spring 51. After passage forwardly beyond the forward edge of latch surface 71*a* the breech block is fully closed, and the lock 49 is in a position to slide down into the latch pocket 71*b* to effect secure locking of the breech block in place against the rear face of the chamber housing 15.

When the breech block 45 is thus fully closed, the chamber/breech block lock 49 is spring-biased down into latch pocket 71*b* formed in protruding latch 71 at the rear of cartridge chamber housing 15, as shown in FIG. 8. During downward or radially inward movement of the chamber lock to the locked position, after the breech is fully closed, an interrupter-contact pin section 49*c* on the forward side of the breech/chamber lock 49 engages the rear chamfered face portion 19*a* of the firing pin interrupter 19, and thereby cams the interrupter 19 forward sufficiently to register slot section 19*bw* with the firing pin 31 and thereby enable unobstructed downward movement of the firing pin 31. Thus, the cartridge primer 103 cannot be actuated by the firing pin 31 unless and until the breech block 45 is fully closed and locked, and once the breech block 45 is closed and locked the firing pin 31 is in full registry with both the primer and the firing-pin-enable wide slot section 19*bw* of the interrupter, whereby firing may be effected as desired.

In addition to moving the interrupter 19 clear of the firing pin 31, the breech block 45 may, if desired, engage a portion of the firing mechanism (not shown) which may suitably include a hammer (not shown) for striking the firing pin 31 to effect firing of the cartridge primer 103 to effect cocking of the firing mechanism hammer (not shown) to the firing position as a function of closure of the breech. When the breech block 45 is opened after firing, the extractor cutout 49*c* and lip 491 in the lower portion of the breech assembly automatically extracts the cartridge from the cartridge chamber 17. Opening is readily accomplished by grasping the handle 55, and pulling down and rearwardly. The downward pivoting of handle 55 about its pivot pin mounting on breech block 45 will raise the lock 49 out of latch pocket 71*b*; through engagement of the short rounded end lever extension 55*a* of handle 55 with the upper end surface of slot 49*s* in lock 49; and the rearward pull on the handle 55 thereafter will effect opening of the breech block 45 by movement on its pivot pin 47, to the fully open position, with the cartridge being thereby extracted by rearward extraction action of the extractor lip 491 on the rim 101*r* of the cartridge 101.

While the invention has been described with respect to a single illustrative and preferred embodiment, it will be apparent that various modifications and improvements may be made without departing from the scope and spirit of the invention. Accordingly, the invention is not to be limited by the illustrative embodiment, but only by the scope of the appended claims.

I claim:

1. A cartridge chamber and breech arrangement comprising a chamber housing having a cartridge chamber formed therein, a firing pin mounted in an opening formed in a side wall of said housing and communicable with the interior of said chamber to enable said firing pin to be in alignment with a side-mounted primer on a projectile when the projectile is fully chambered, a breech block movable from an open position to a closed chamber position relative to said cartridge chamber, lock means for locking said breech block in said closed position, and a movable interrupter on said housing and being normally spring-biased to a firing-pin-movement-interrupt position whereby the firing pin is prevented from firing, said interrupter being movable in response to closure and locking of said breech block, to thereby move to a noninterrupt position relative to said firing pin and thereby enable said firing pin to be actuated for firing of a cartridge primer aligned therewith only when such cartridge is chambered and securely locked in position by said breech block and breech block lock.

2. An arrangement according to claim 1, and pivot mounting means for pivotally mounting said breech block on said cartridge chamber housing.

3. An arrangement according to claim 1, and spring means resiliently biasing said firing pin away from said cartridge chamber.

4. An arrangement according to claim 3, said interrupter being slidably mounted on said chamber housing, said interrupter having a dual width slot formed therein, one slot section of which is wider than the other slot section, said firing pin having a necked-down section smaller than said narrower slot section, and having an anvil section larger in width than the width of said narrower slot section and smaller than the size of said wider slot section, spring means normally biasing said interrupter to a position in which said narrower slot section is in firing-movement-interrupt relation about said necked-down section of said firing pin, and means on said breech block for movement of said interrupter to align said wider slot section with said firing pin when said breech is fully closed and locked.

5. An arrangement according to claim 4, and movable lock means on said breech block for locking engagement with latch means on said cartridge housing, said interrupter being movable to said firing-pin-aligned position in response to movement of said lock into locking relation with said latch means.

6. An arrangement according to claim 5, said lock means having means thereon engageable with said interrupter and effecting sliding movement of said interrupter in response to latch-engaging movement of said lock means.

7. An arrangement according to claim 6, said lock means comprising a movable member slidably mounted on said breech block and having latch-engaging means and interrupter-engaging means.

8. An arrangement according to claim 7, said latch-engaging means on said lock including a chamfered cam surface effective to slide said lock means up and over said latch for latch-locking engagement, said interrupter-engaging means on said lock including a surface engaging in camming movement action with said interrupter during reverse movement of said lock means after said up and over movement thereof, and spring means resiliently biasing said lock means in said reverse movement direction.

9. An arrangement according to claim 8, pivot mounting means for pivotally mounting said breech block on said cartridge chamber housing, and a handle pivotally mounted on said breech block and engaging said lock means in locking and unlocking movement relation.

10. An arrangement according to claim 9, said breech block and said cartridge housing each having an opening therein for passage therethrough of propellant gases from a cartridge fired within said cartridge chamber.

* * * * *